US009004856B2

(12) United States Patent
Lange et al.

(10) Patent No.: US 9,004,856 B2
(45) Date of Patent: Apr. 14, 2015

(54) INLET CONNECTING PIECE FOR AN AXIAL-FLOW COMPRESSOR

(75) Inventors: Christoph Lange, Cologne (DE); Henning Ressing, Bottrop (DE); Fikri Aynacioglu, Remscheid (DE); Dirk Anding, Bottrop (DE); Karl-Heinz Dreyer, Wesel (DE)

(73) Assignee: MAN Diesel & Turbo SE, Augsburg (DE)

( * ) Notice: Subject to any disclaimer, the term of this patent is extended or adjusted under 35 U.S.C. 154(b) by 628 days.

(21) Appl. No.: 12/866,077

(22) PCT Filed: Nov. 3, 2008

(86) PCT No.: PCT/EP2008/009254

§ 371 (c)(1),
(2), (4) Date: Aug. 4, 2010

(87) PCT Pub. No.: WO2009/100741

PCT Pub. Date: Aug. 20, 2009

(65) Prior Publication Data

US 2010/0329861 A1 Dec. 30, 2010

(30) Foreign Application Priority Data

Feb. 13, 2008 (DE) ..... 10 2008 008 886

(51) Int. Cl.

| | |
|---|---|
| ***F01D 25/16*** | (2006.01) |
| ***F04D 29/059*** | (2006.01) |
| ***F01D 9/06*** | (2006.01) |
| ***F04D 19/02*** | (2006.01) |
| ***F04D 29/52*** | (2006.01) |
| ***F04D 29/64*** | (2006.01) |
| ***F04D 29/66*** | (2006.01) |

(52) U.S. Cl.

CPC ..... *F04D 29/059* (2013.01); *F01D 9/065* (2013.01); *F01D 25/162* (2013.01); *F04D 19/02* (2013.01); *F04D 29/522* (2013.01); *F04D 29/644* (2013.01); *F04D 29/668* (2013.01)

(58) Field of Classification Search

USPC ..... 415/110, 112, 115, 116, 117, 183, 194, 415/208.1, 142

See application file for complete search history.

(56) References Cited

U.S. PATENT DOCUMENTS

| | | | | |
|---|---|---|---|---|
| 2,648,493 | A * | 8/1953 | Stalker | 415/62 |
| 2,665,549 | A | 1/1954 | Newcomb | |
| 3,890,780 | A * | 6/1975 | Hagemeister et al. | 60/39.08 |

(Continued)

FOREIGN PATENT DOCUMENTS

| | | |
|---|---|---|
| EP | 0 122 328 | 10/1984 |
| GB | 583 469 | 12/1946 |
| WO | WO 2009/100741 | 8/2009 |

*Primary Examiner* — Dwayne J White
*Assistant Examiner* — Justin Seabe
(74) *Attorney, Agent, or Firm* — Cozen O'Connor

(57) ABSTRACT

An inlet connection piece for an axial compressor, particularly for a turbocompressor, includes an inlet housing (1) in which is arranged a bearing housing (2) with a bearing (3), particularly a radial and/or axial bearing, for a rotor. The bearing housing (2) is connected to the inlet housing (1) by an inlet strut (4) which is connected to the inlet housing in a front cross section. The center of the bearing (3) is arranged axially in the flow direction of a fluid to be compressed behind the area center of the front cross section by at least 0.1-times, particularly at least 0.15-times, particularly at least 0.2-times, particularly at least 0.25-times, the chord length of the front cross section. In addition or alternatively, a fluid passage (5, 6) is formed in the inlet strut (4), and at least portions of this fluid passage (5, 6) form an acute angle with a normal plane relative to the longitudinal axis of the inlet connection piece.

17 Claims, 2 Drawing Sheets

(56) References Cited

U.S. PATENT DOCUMENTS 4,972,671 A * 11/1990 Asselin et al. ..... 60/39.08
5,253,985 A * 10/1993 Ruetz ..... 417/407
5,941,683 A * 8/1999 Ridyard et al. ..... 415/142
6,030,176 A * 2/2000 Oeynhausen ..... 415/214.1
6,330,790 B1 * 12/2001 Arora et al. ..... 60/39.08
6,835,044 B2 * 12/2004 Frosini ..... 415/111
2007/0028589 A1 * 2/2007 Alexander et al. ..... 60/39.08

* cited by examiner

INLET CONNECTING PIECE FOR AN AXIAL-FLOW COMPRESSOR

PRIORITY CLAIM

This is a U.S. national stage of application No. PCT/EP2008/009254, filed on Nov. 3, 2008. Priority is claimed on the following application: Country: Germany, Application No. 10 2008 008 886.2, Filed: Feb. 13, 2008, the content of which is/are incorporated here by reference.

FIELD OF THE INVENTION

The invention is directed to an inlet connection piece for an axial compressor, particularly for a turbocompressor, with an inlet housing in which is arranged a bearing housing with an axially first bearing in the flow direction of a liquid to be compressed for a rotor of the axial compressor, the bearing housing being connected to the inlet housing by an inlet strut which is connected to the inlet housing in a front cross section.

BACKGROUND OF THE INVENTION

In conventional axial compressors, inlet struts of the type mentioned above extend exclusively radially, i.e., parallel to a normal plane of the longitudinal axis of the inlet connection piece, so that the center of the first, or front, bearing is arranged axially in the flow direction of a fluid to be compressed substantially level with the area center of this front cross section; in other words, the bearing is arranged axially in the center of the inlet strut below the point where it merges with the inlet housing.

In the present context, the center of the bearing refers in particular to a piercing point of a bearing axis through a plane of symmetry of a symmetrical bearing, a center of mass of the bearing, the geometric center between the axial end faces of the bearing, or a pressure point of the bearing.

Since the inlet struts are often connected to the inlet housing relatively far axially in front toward the inlet cross section of the inlet connection piece, particularly for purposes of robustness and for reasons pertaining to manufacture, in order to find support, for example, against corresponding reinforcements of the inlet housing or, when cast, to prevent sharp variations in wall thickness, the first, or front, bearing is also arranged correspondingly far to the front resulting in a relatively large distance between this bearing and a second, rear bearing of the rotor of the axial compressor which is arranged behind the first bearing in the flow direction.

One or more fluid passages can be formed in the inlet struts. Fluid passages of this kind can be used, for example, for lubrication of the bearing and, to this end, open into the bearing housing in, or in the vicinity of, the bearing on one side and are connected to a lubricant supply or lubricant discharge outside the inlet housing on the other side, for example, by means of lubricating nipples, lines, passages in adjoining housing parts, or the like.

Fluid passages of this kind formerly extended substantially radially in order to minimize the length of the fluid passage and, therefore, to minimize weakness in the inlet strut supporting the bearing housing and the cost for producing them, which was generally carried out by cutting.

As a result, a bearing supplied by the radial fluid passage must be arranged axially at the height of the outlet opening of the fluid passage exiting from the inlet housing, which likewise disadvantageously increases the center-to-center distance between the bearings of the rotor. However, a greater center-to-center bearing distance can negatively influence the rotor dynamics.

SUMMARY OF THE INVENTION

Therefore, it is the object of the present invention to provide an improved inlet connection piece.

This object is met by providing an inlet connection piece for an axial compressor, particularly for a turbocompressor, with an inlet housing in which is arranged a bearing housing with an axially first bearing in the flow direction of a liquid to be compressed, particularly a radial and/or axial bearing, for a rotor of the axial compressor, wherein the bearing housing is connected to the inlet housing by at least one inlet strut which is connected to the inlet housing in a front cross section, the center of the bearing in the flow direction is arranged axially behind the area center of the front cross section by at least 0.1-times, particularly at least 0.15-times, particularly at least 0.2-times, and particularly at least 0.25-times, the chord length of the front cross section; and/or at least one fluid passage is formed in the at least one inlet strut and at least portions of this fluid passage form an acute angle with a normal plane relative to the longitudinal axis of the inlet connection piece. An axial compressor with an inlet connection piece of this kind is also disclosed.

An inlet connection piece according to the invention is provided for an axial compressor, particularly a turbocompressor, and can preferably be detachably or fixedly connected to the latter or formed integral with it. It has an inlet housing whose interior space preferably narrows in diameter in the direction of flow of a fluid to be compressed. A bearing housing receiving a front, or first, bearing for a rotor of the axial compressor is arranged in the inlet housing. This bearing can be a radial bearing, an axial bearing or a radial-axial bearing. This bearing is a first, i.e., front, bearing axially in the flow direction of a fluid to be compressed. The rotor can be supported in additional bearings arranged at a greater axial distance from an inlet cross section of the inlet connection piece.

The bearing housing is supported in the inlet housing by one or more inlet struts. A plurality of inlet struts can be distributed equidistantly along the circumference of the bearing housing or at different angular distances from one another. Whereas equidistantly distributed inlet struts interfere with the flow in the bearing housing homogeneously and therefore minimally, inlet struts at different angular distances from one another can be adapted to constructional boundary conditions of the housing, particularly external feed lines, ribs, different wall thicknesses, or the like.

One or more inlet struts are connected to the inlet housing in a front cross section of the corresponding inlet strut. In particular, one or more, preferably all, of the inlet struts can be connected in one piece to the inlet housing and/or bearing housing, for example, by primary shaping. Similarly, one or more inlet struts can also be connected, e.g., welded or screwed, to the inlet housing and/or bearing housing after primary shaping.

According to a first embodiment of the present invention, the center of the first bearing in the flow direction of a fluid to be compressed is arranged axially behind the area center of the front cross section of the inlet strut by at least 0.1-times, preferably at least 0.15-times, more preferably at least 0.2-times, and particularly preferably at least 0.25-times, the chord length of the front cross section. Chord length designates the maximum extension of the front cross section of the inlet strut in axial direction, i.e., in the flow direction of a fluid to be compressed, which corresponds, for example, in case of a circular front cross section, to its diameter and, in case of an elliptical front cross section, to its semi-major axis.

According to a first embodiment, it is proposed that the first bearing is arranged behind the area center of a front cross section of the inlet strut. In this way, the bearing distance from the center of mass of the rotor and—if provided—from a second, rear bearing of the rotor of the axial compressor arranged behind the first bearing in the flow direction is shortened in an advantageous manner.

The first bearing can be arranged in particular behind the first two thirds of the chord length, i.e., by at least 0.17-times, preferably behind the first three fourths of the chord length, i.e., by at least 0.25-times, behind the area center of the front cross section of the inlet strut.

According to the first embodiment of the present invention, when the bearing housing is connected to the inlet housing by a plurality of inlet struts, the center of the first bearing is arranged axially behind the area center of the front cross section of at least one inlet strut by at least 0.1-times, 0.15-times, 0.2-times, or 0.25-times the chord length of the front cross section. Accordingly, there can also be inlet struts with respect to whose front cross section the first bearing is arranged axially in front of or in the area center. In a preferred further embodiment, the center of the first bearing is arranged behind the area centers of the front cross sections of all of the inlet struts by 0.1-times, 0.15-times, 0.2-times, or 0.25-times the chord length of the front cross section.

The bearing center need no longer lie inside the chord length of the front cross section or front cross sections that is projected on the longitudinal axis of the inlet connection piece, but rather can also be arranged axially behind the front cross section or front cross sections. However, it can also lie behind the area center of the front cross section inside the chord length of the front cross section or front cross sections which is projected on the longitudinal axis of the inlet connection piece, in particular at most by 0.75-times, particularly at most by 0.5-times, the chord length of the front cross section of the inlet strut.

According to a second embodiment of the present invention, a fluid passage is formed in at least one inlet strut. This fluid passage can be provided in particular for guiding lubricant to and/or away from the bearing for the impeller. Similarly, a fluid passage can also serve to supply and/or remove cooling fluid, particularly cooling air, and/or a blocking fluid, particularly blocking air, to cool the axial compressor or to prevent lubricant from escaping into the axial compressor. Other fluids, for example, a hydraulic fluid, particularly of a regulated bearing, can also flow through the fluid passage. Particularly with respect to the functions mentioned above, a fluid passage can open into the bearing housing in, or in the vicinity of, the bearing in a preferred embodiment. In addition to or as an alternative to a fluid, the fluid passage, which is so designated only for the sake of simplicity, can also be formed in the bearing housing, for example, to guide cables, lines or the like, for example, electrical and/or optical lines for sensors.

According to the second embodiment of the present invention, it is proposed that at least portions of a fluid passage of the kind mentioned above enclose an acute angle with a normal plane relative to the longitudinal axis of the inlet connection piece, i.e., extend diagonal to the axial direction of the inlet connection piece, in particular from the radial outer side to the radial inner side in the flow direction of the fluid to be compressed.

By means of this constructional modification of conventional fluid passages which only extend radially, it is possible in an advantageous manner to offset the bearing axially toward the rear in the flow direction of the fluid to be compressed in order to shorten the center-to-center distance of the bearings and in order to reduce or prevent problems relating to the dynamics of the rotor. At the same time, it is possible to arrange feed lines to the fluid passages at the outer surface of the inlet housing in an optimal manner, for example, further toward the front in the flow direction of the fluid to be compressed and, therefore, to provide reinforcements such as ribs or the like at the outer surface of the inlet housing in the area of the inlet strut(s).

The first and second embodiments can advantageously be combined. When the first bearing according to the first embodiment is offset axially toward the rear relative to the front cross section of an inlet strut, its operation can be served in a particularly advantageous manner by diagonally extending fluid passages of this inlet strut. However, insofar as permitted by the cross section of an inlet strut, fluid passages in the first embodiment can also extend only radially or, conversely, diagonal fluid passages can be provided in exclusively radially oriented inlet struts in which the bearing center lies axially below the area center of the front cross section. To this extent, the following description relates in equal measure to the first and/or second embodiment(s) of the present invention.

In one or more inlet struts, a plurality of, particularly two or three, fluid passages can be formed, wherein at least one, preferably a plurality of, particularly preferably all of, the fluid passages form an acute angle with a normal plane relative to the longitudinal axis of the inlet connection piece. Fluid passages of this kind can preferably extend substantially parallel to one another, which simplifies manufacturing. However, they can also enclose different angles with the normal plane so as to define particularly optimal paths between outlet positions at the inlet housing and at the bearing housing. In this way, for example, fluid passages which open into the bearing housing close to one another can be connected to feed lines at the inlet housing which are at a distance from one another axially, or vice versa.

A different quantity of fluid passages can be formed in two inlet struts in order, for example, to optimally distribute the feed lines and discharge lines. Also, fluid passages in the same inlet struts or different inlet struts need not have the same diameter, but can be adjusted, for example, to the nature and amount of the medium to be supplied and removed.

One or more fluid passages can extend substantially in a straight line so that they everywhere form the same acute angle with a normal plane relative to the longitudinal axis of the inlet connection piece. Fluid passages of this kind are produced in an especially simple manner by means of bore holes and are to be taken into account in the design.

The angle formed by a fluid passage extending substantially in a straight line with the normal plane relative to the longitudinal axis of the inlet connection piece can preferably range from 10° to 40°, particularly from 20° to 30°. This represents a good compromise between a shorter bearing center distance and a higher manufacturing cost.

One or more fluid passages can also have a bent shape so that at least a portion of this fluid passage forms an acute angle with a normal plane relative to the longitudinal axis of the inlet connection piece. On the other hand, other portions of fluid passages of this kind can extend, for example, substantially in radial direction of the inlet housing. In this way, the advantages of purely radially extending and diagonally extending fluid passages can be combined.

The angle formed by such a diagonal portion of a fluid passage with a bent shape with a normal plane relative to the longitudinal axis of the inlet connection piece is preferably in the range of 60° to 80°, particularly in the range of 65° to 75°. Since in this case there is only a short distance available in radial direction to compensate for the axial offset between the inlet and outlet of the fluid passage, diagonal portions of the kind mentioned above preferably have a larger angle to the normal plane than fluid passages without bends.

In a preferred embodiment, two or more fluid passages open into a common portion which communicates with the interior of the bearing housing. This portion can extend diagonally in particular, while the fluid passages opening into it preferably extend substantially in radial direction of the inlet housing. In this way, points which are supplied through or discharged through such fluid passages which extend substantially only radially can be served by a common diagonal portion, which advantageously lowers production cost and reduces weakening of the inlet strut.

A radial axis through the area centers or centroids of at least one inlet strut can also—at least in some areas—form an acute angle with a normal plane relative to the longitudinal axis of the inlet connection piece. To this end, for example, an inlet strut with a constant cross section can be formed diagonally in its entirety, particularly so as to narrow in diameter toward the bearing housing in the flow direction of a fluid to be compressed. A swept inlet strut of this kind is particularly suitable for receiving straight-line fluid passages. In order to receive the latter in particular, but also to receive bent fluid passages and to support a first bearing which is offset axially toward the rear, an inlet strut can also extend substantially in radial direction of the inlet housing and widen toward the bearing housing so that the area center or centroid shifts to the rear toward the bearing housing in the flow direction of a fluid to be compressed.

BRIEF DESCRIPTION OF THE DRAWINGS

Further advantages and features are discussed below in connection with the drawings in which.

DETAILED DESCRIPTION OF THE PRESENTLY PREFERRED EMBODIMENTS

Figure 1:
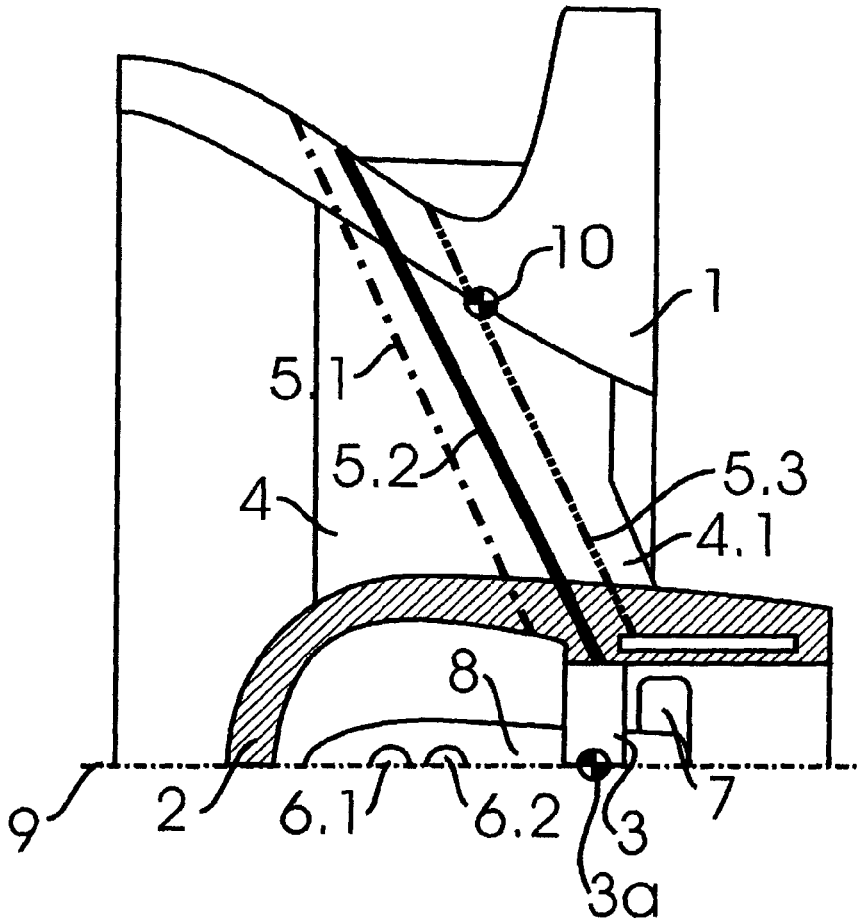
FIG. 1 shows an inlet connection piece according to an embodiment of the present invention in half-section.
Figure 2:
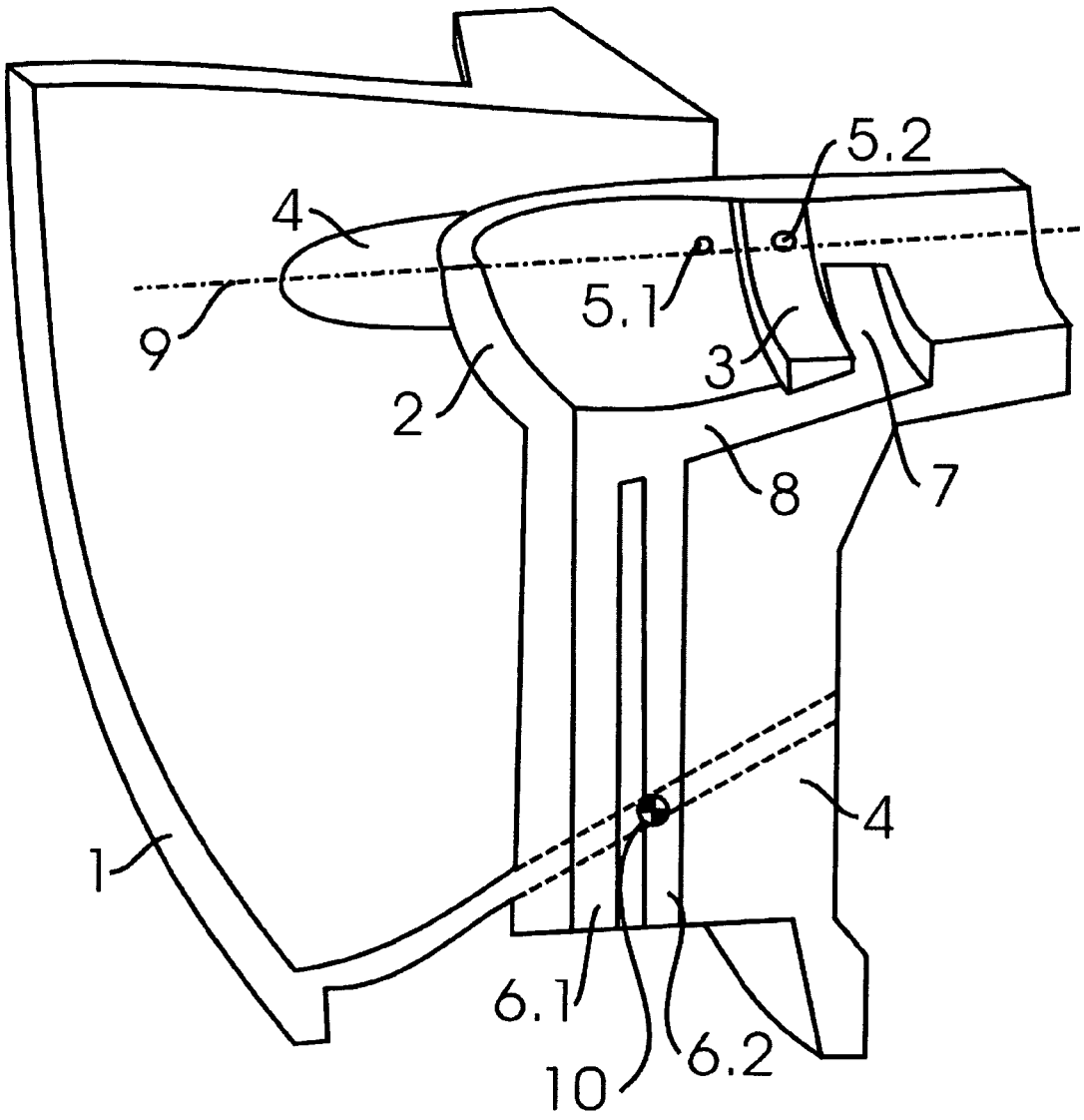
FIG. 2 shows the inlet connection piece according to FIG. 1 in a perspective quarter-sectional view.

FIG. 2 is a perspective view showing the cut-away bottom left-hand fourth of an inlet connection piece according to an embodiment of the present invention considered in the flow direction of a fluid to be compressed. FIG. 1 shows a horizontal section from FIG. 2.

The inlet connection piece has an inlet housing 1 for collecting and supplying a medium to a turbocompressor (not shown). A bearing housing 2 is arranged in the inlet housing 1. This bearing housing 2 has a substantially cylindrical shape with a front, hemispherical end face in the flow direction of the medium to be compressed (from left to right in the drawings). A radial bearing 3 for a rotor with an impeller of the turbocompressor (not shown) is formed in the bearing housing 2, the bearing center 3*a* lying axially in the center of the bearing ring shown in the drawing.

The bearing housing 2 is connected to the inlet housing 1 by three, four, or more inlet struts. A lower inlet strut 4 (in section) and a left-hand inlet strut 4 (partially hidden) can be seen in FIG. 2. FIG. 1 shows the left-hand inlet strut 4.

In a modification, not shown, two or more blind struts which are not connected to the bearing housing are additionally arranged in the upper half of the inlet housing.

The left-hand inlet strut 4 shown in FIG. 1 is connected integral with the inlet housing 1 and merges with it in its front cross section of the inlet strut facing the inlet housing 1. The area center 10 of this front cross section is shown in FIG. 1 and, as can be seen, is situated axially in front of the bearing center 3*a* which is offset axially toward the rear (toward the right referring to FIG. 1) relative to this area center by a factor of 0.375 in the flow direction of a fluid to be compressed.

Three fluid passages 5 are formed in the left-hand inlet strut 4. FIG. 1 shows a left-hand, front fluid passage 5.1 (dash-dot lines) which serves to guide lines for sensors to the bearing 3 and opens into the bearing housing 2 in the vicinity of the bearing 3 in front of this bearing 3, a middle fluid passage 5.2 (solid lines in FIG. 1) serving to supply lubricant to the bearing 3 and opening into the bearing housing 2 in the bearing 3, and a right-hand, rear fluid passage 5.3 (dash-double-dotted lines in FIG. 1) serving to supply blocking air to the bearing housing 2 and opening into the bearing housing 2 after the bearing 3 in the vicinity of the latter.

These fluid passages 5 are formed as through-holes and therefore extend substantially in a straight line. They enclose an acute angle of about 23° with a normal plane relative to the longitudinal axis of the inlet connection piece (vertical plane perpendicular to the drawing plane in FIG. 1) and the complementary angle of approximately 67° with the longitudinal axis.

Two fluid passages 6 which serve to remove lubricant from the interior of the bearing housing 2 are formed in the lower inlet strut 4. Portions of these fluid passages 6 form an acute angle with a normal plane relative to the longitudinal axis of the inlet connection piece. To this end, they have a bent shape, wherein a portion 6.1 or 6.2 extending substantially in radial direction passes into a portion 8 which is common to both fluid passages 6 and which forms an acute angle of about 72° with a normal plane relative to the longitudinal axis of the inlet connection piece.

This common diagonal portion 8 extends in longitudinal direction of the inlet housing 1 (from left to right in FIG. 1) and opens at the end into a circular segment-shaped annular groove 7 which is formed at right angles to the portion 8 and extends along an area of 70° in the lower half of the bearing housing 2. The two fluid passages communicate with the interior of the bearing housing 2 via the annular groove 7 arranged behind the bearing 3 and via the common portion 8 which opens toward the interior of the bearing housing 2 and extends from the annular groove 7 through the radial bearing 3 toward the front until the portions 6.1, 6.2 which extend in radial direction.

As can be seen in FIG. 2, the center of the bearing 3 is axially offset toward the rear also with respect to the area center 10 of the lower inlet struts 4 and lies in the last third of its chord length projected on the longitudinal axis 9.

As can be seen particularly clearly in FIG. 1, the inlet struts 4 extend substantially in radial direction (from top to bottom in FIG. 1). In order to have sufficient material on both sides for the diagonally extending fluid passages 5 and the diagonal common portion 8 and so that the bearing center can be well supported, the inlet struts 4 have a substantially triangular projection 4.1 at their rear flow-off edge in the flow direction of the fluid to be compressed (at right in FIGS. 1, 2). Therefore, a radial axis through the area centers of the inlet struts 4 forms, with the shoulder 4.1, an acute angle in this portion with a normal plane relative to the longitudinal axis of the inlet connection piece.

The invention is not limited by the embodiments described above which are presented as examples only but can be modified in various ways within the scope of protection defined by the appended patent claims.

The invention claimed is:

1. An inlet connection piece for an axial compressor comprising:

an inlet housing (1);

a bearing housing (2) disposed in said inlet housing (1), both said bearing housing and said inlet housing defining a main fluid passage for a main fluid flow to be compressed in a fluid flow direction;

an axial hydrodynamic bearing (3) for a rotor of the axial compressor, said bearing disposed in said bearing housing in a flow direction of the fluid to be compressed, said bearing having a center (3*a*) and being the first bearing in said fluid flow direction;

at least one inlet strut (4) formed as a single body, non-rotatably connected to said inlet housing (1) in a front cross-section having a center and a chord length; said inlet strut directly connecting said bearing housing (2) to said inlet housing (1) in the main fluid passage; and wherein (a) said center (3*a*) of said bearing (3) in the flow direction is arranged axially within said cord length of said inlet strut and behind said center of said front cross-section by one of at least 0.1-times, at least 0.15-times, at least 0.2-times or at least 0.25-times said chord length of said front section of said inlet strut; and (b) said at least one inlet strut (4) comprising at least one fluid passage (5, 6) defined in and extending through said single body inlet strut, at least a portion of said fluid passage forming an acute angle with a normal plane relative to a longitudinal axis of said inlet connection piece.

2. The inlet connection piece according to claim 1, wherein said bearing housing (2) is connected to said inlet housing (1) by a plurality of inlet struts (4).

3. The inlet connection piece according to claim 1, wherein said bearing housing (2) is connected to said inlet housing (1) by three or more evenly or unevenly distributed inlet struts.

4. The inlet connection piece according to claim 1, comprising a plurality of fluid passages (5.1, 5.2, 5.3; 6.1, 6.2) in said at least one inlet strut (4).

5. The inlet connection piece according to claim 2, wherein a plurality of fluid passages (6.1, 6.2) is formed in a first inlet strut (4) and a different quantity of fluid passages (5.1, 5.2, 5.3) is formed in a second inlet strut (4).

6. The inlet connection piece according to claim 1, wherein said at least one fluid passage (5) extends substantially in a straight line so that said fluid passage forms the same acute angle with a normal plane relative to a longitudinal axis of the inlet connection piece.

7. The inlet connection piece according to claim 6, wherein the angle formed by said fluid passage (5) extending substantially in a straight line with a normal plane relative to the longitudinal axis of the inlet connection piece is in the range of 10° to 40°.

8. The inlet connection piece according to claim 1, wherein said at least one fluid passage (6) has a bent shape so that at least a portion (8) of said fluid passage forms an acute angle with a normal plane relative to the longitudinal axis of said inlet connection piece.

9. The inlet connection piece according to claim 8, wherein said angle formed by said portion (8) of said fluid passage (6) with a bent shape with a normal plane relative to the longitudinal axis of the inlet connection piece is in the range of 60° to 80°.

10. The inlet connection piece according to claim 1, additionally comprising a common portion (8) communicating with the interior of the bearing housing (2), and wherein at least two fluid passages (6.1, 6.2) open into said common portion (8).

11. The inlet connection piece according to claim 1, additionally comprising a fluid passage formed for one of supplying and removing lubricant to or from said bearing (3).

12. The inlet connection piece according to claim 1, wherein said fluid passage (5, 6) opens into said bearing housing (2) in said bearing (3).

13. The inlet connection piece according to claim 1, wherein said at least one inlet strut has an area center and a radial axis and wherein at least portions of said radial axis through said area centers of said at least one inlet strut form an acute angle with a normal plane relative to the longitudinal axis of the inlet connection piece.

14. The inlet connection piece according to claim 6, wherein said angle formed by said fluid passage (5) extending substantially in a straight line with a normal plane relative to the longitudinal axis of the inlet connection piece is in the range of 20° to 30°.

15. The inlet connection piece according to claim 8, wherein said angle formed by said portion (8) of said fluid passage (6) with a bent shape with a normal plane relative to the longitudinal axis of the inlet connection piece is in the range of 65° to 75°.

16. The inlet connection piece according to claim 1, wherein said fluid passage (5, 6) opens into said bearing housing (2) in the vicinity of said bearing (3).

17. An axial compressor comprising an inlet connection piece comprising:

an inlet housing (1);

a bearing housing (2) disposed in said inlet housing (1), both said bearing housing and said inlet housing defining a main fluid passage for a main fluid flow to be compressed in a fluid flow direction;

an axial bearing (3) for a rotor of the axial compressor, said bearing disposed in said bearing housing in a flow direction of the fluid to be compressed, said bearing having a center (3*a*) and being the first bearing in said fluid flow direction;

at least one inlet strut (4) formed as a single body, non-rotatably connected to said inlet housing (1) in a front cross-section having a center and a chord length; said inlet strut directly connecting said bearing housing (2) to said inlet housing (1) in the main fluid passage; and wherein (a) said center (3*a*) of said bearing (3) in the flow direction is arranged axially within said cord length of said inlet strut and behind said center of said front cross-section by one of at least 0.1-times, at least 0.15-times, at least 0.2-times and at least 0.25-times said chord length of said front section of said inlet strut; and (b) said at least one inlet strut (4) comprising within said at least one fluid passage (5, 6) defined in and extending through said single body inlet strut, at least a portion of said fluid passage forming an acute angle with a normal plane relative to a longitudinal axis of the inlet connection piece.

* * * * *